United States Patent [19]

Chapin

[11] 4,087,491

[45] May 2, 1978

[54] CARBURETOR WITH HOLLOW AIR CONTROL VALVE

[75] Inventor: Leonard Lee Chapin, El Paso, Tex.

[73] Assignee: Autotronic Controls, Corp., El Paso, Tex.

[21] Appl. No.: 783,611

[22] Filed: Apr. 1, 1977

[51] Int. Cl.[2] ..... F02M 9/12

[52] U.S. Cl. ..... 261/36 A; 261/55; 261/64 A; 261/79 R; 261/DIG. 48

[58] Field of Search ..... 261/64 A, 79 R, 55, 261/36 A, 50 R

[56] References Cited

U.S. PATENT DOCUMENTS

| | | | |
|---|---|---|---|
| 1,275,032 | 8/1918 | Huene | 261/64 A |
| 1,290,028 | 1/1919 | Abbey | 261/64 A |
| 1,615,111 | 1/1927 | Cuff | 261/64 A |
| 1,620,925 | 3/1927 | Tangye | 261/79 R |
| 2,022,957 | 12/1935 | Drouin | 261/50 R |
| 3,329,412 | 7/1967 | Knappett | 261/50 R |
| 3,512,359 | 5/1970 | Pierce | 261/79 R |
| 3,817,225 | 6/1974 | Priegel | 123/139 AW |
| 3,822,868 | 7/1974 | Carnes | 261/50 R |
| 3,877,449 | 4/1975 | High | 261/79 R |

FOREIGN PATENT DOCUMENTS

| | | | |
|---|---|---|---|
| 468,909 | 11/1928 | Germany | 261/79 R |
| 101,247 | 9/1923 | Switzerland | 261/79 R |

*Primary Examiner*—Tim R. Miles

*Attorney, Agent, or Firm*—Fitch, Even, Tabin & Luedeka

[57] ABSTRACT

A carburetor for an internal combustion engine having an intake manifold includes a hollow air control valve, preferably conical, formed by outer and inner hollow valve members having mating surfaces of revolution about an axis. The inner valve member confines a coaxial internal mixing chamber having a cross section increasing in the direction away from the mating surfaces and terminating in an open end extending toward the intake manifold. The valve members are mounted to intercept air inflow into the intake manifold with the valve members being turnable relative to each other about the axis to change the overlap of respective openings and thereby vary the constriction of air flow at the overlaps to control the rate of air flow into the intake manifold. The respective openings are relatively disposed to direct air flow through each overlap with a transverse component of air flow offset from the direction toward the axis, thereby causing a swirling of air within the mixing chamber. Liquid fuel is introduced into air swirling within said mixing chamber.

29 Claims, 20 Drawing Figures

AIR
FILTER
AIR FLOW TRANSDUCER
CONTROLLER
RETURN
PRESSURE REG
EQUALIZER VALVE
FUEL TANK
SUPPLY PUMP
METERING PUMP
CONICAL THROTTLE
THROTTLE ROD

Fig. 8.
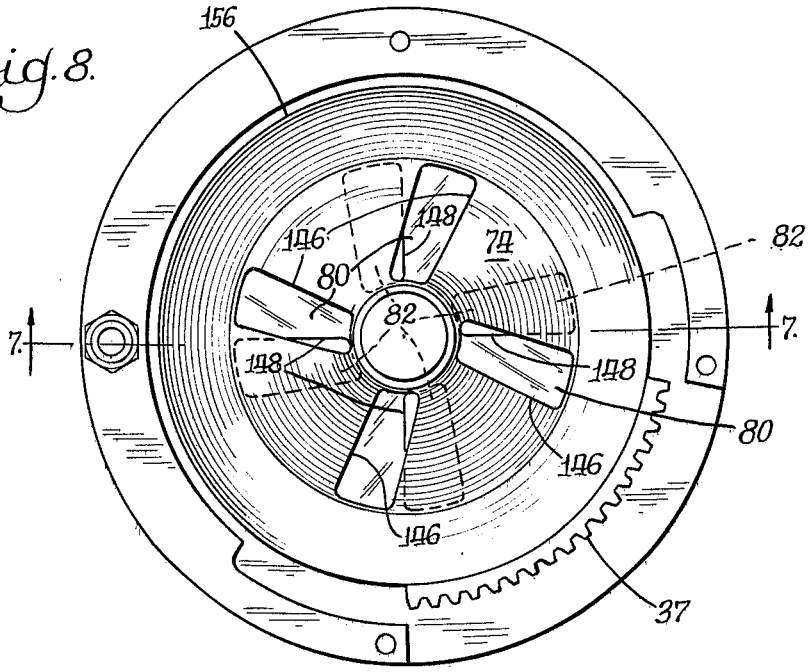
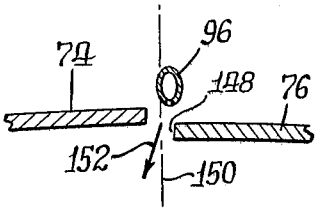
Fig. 9.
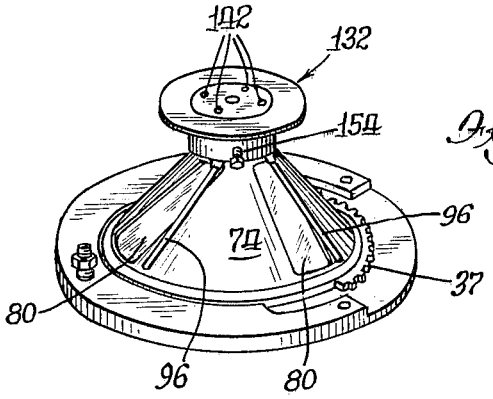
Fig. 10.
Fig. 11.
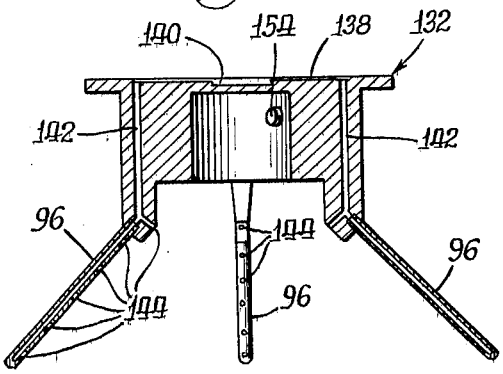
Fig. 12.
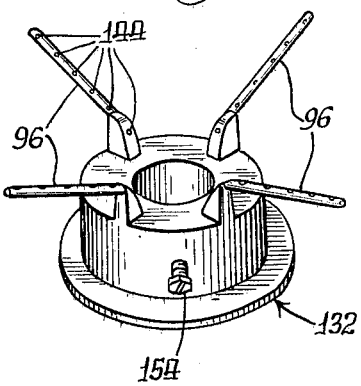

Fig. 18.
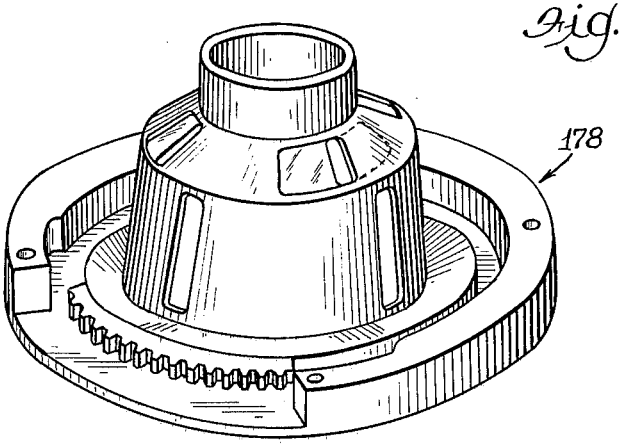
Fig. 19.
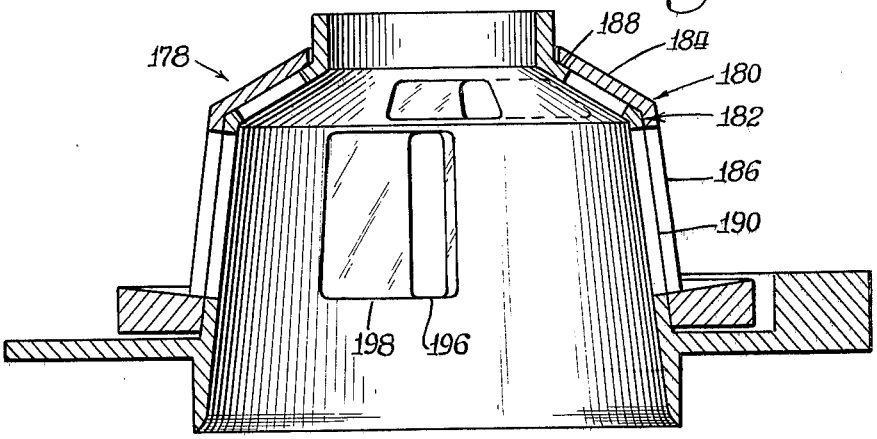
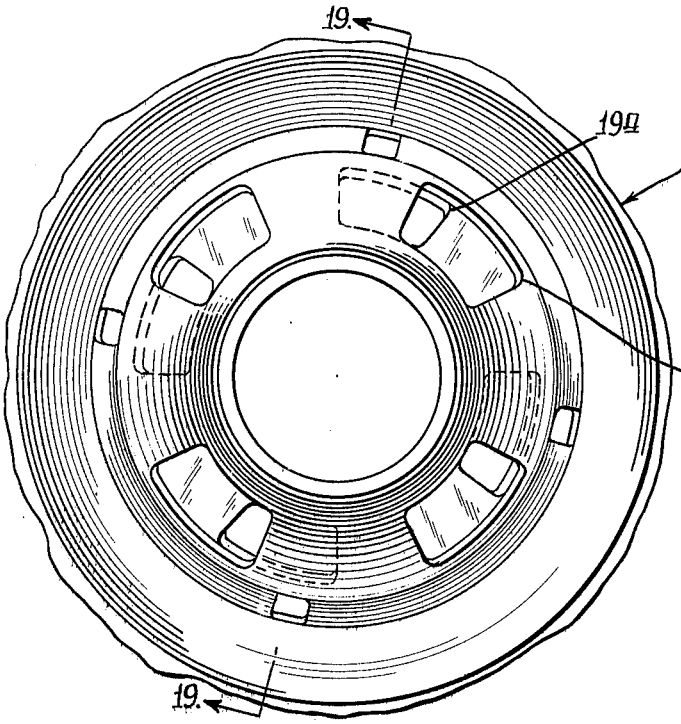
Fig. 20.

CARBURETOR WITH HOLLOW AIR CONTROL VALVE

This invention relates to carburetors for internal combustion engines having intake chambers and more particularly to carburetors that include a pair of relatively rotatable valve members confining a coaxial internal mixing chamber having a cross section increasing in the direction of the intake chamber, which carburetors in a preferred form may include a conical throttle valve. The term "carburetor" as used herein is not limited to common automobile carburetors but is used in the general sense of apparatus in which air is mixed with fuel and includes an air control valve therefor.

Carburetors commonly perform a number of functions culminating in the delivery of an appropriate air-fuel mixture to the intake manifold of an internal combustion engine, which may be a conventional gasoline fueled piston driven automobile engine. Standard carburetors have a butterfly valve actuated by an accelerator pedal in an automobile to control the rate of flow of air drawn into the intake manifold by the pumping action of the pistons. Carburetors conventionally include venturi tubes for inducing fuel into the carburetor, where fuel is mixed with the air to provide an appropriate mixture for burning in the engine.

The present invention is particularly useful in internal combustion engines wherein fuel is supplied in metered amounts, in particular in amounts providing a particular desired ratio of air to fuel. The carburetor of the present invention not only controls air flow but directs the flow to provide controlled swirling within the mixing chamber of the carburetor as promotes shearing of fuel droplets with consequent vaporization thereof and intimate mixture of fuel and air.

In accordance with the present invention a carburetor is formed of a pair of valve control members having mating surfaces of revolution whereby the valve members may be turned relative to one another about the axis of revolution. Preferably, the valve members are conical shells with their open ends extending in the direction of the intake chamber of an internal combustion engine. Thus, the inner control valve member forms an internal mixing chamber coaxial therewith. Its exterior surface is a surface of revolution mating with the internal surface of revolution of the outer valve member. The outer valve member has a plurality of first openings spaced around the axis and extending through the valve member to its interior surface. The inner valve member has corresponding second openings extending between its exterior surface and the mixing chamber defined by the inner valve member. Means is provided as by a linkage to an accelerator pedal for turning the inner and outer valve members relative to one another to change the overlap of the respective openings and thereby vary the constriction of air flow at the overlaps to control the rate of air flow into the intake chamber.

The surfaces of the valve member slope away from the axis of revolution in the direction of the open ends of the valve members to direct air flow through each overlap of the openings with an axial component of air flow through such overlap into the mixing chamber in the direction of the open end and a transverse component orthogonal to the axial component. "Axial component" is used herein to mean a component directed parallel to the axis of the surfaces of revolution. Further, the first openings are so disposed relative to the second openings as to direct air flow through each overlap to offset the transverse component from the direction of the axis, thereby causing a controlled swirling of air within the mixing chamber.

Means are also provided for introducing liquid fuel into the air swirling within the mixing chamber.

Preferably, the direction transverse to the effective constriction at each overlap produces swirling air without such centrifugal forces as would cause substantial wetting out of fuel particles carried by the swirling air onto the interior surface of the inner valve member.

The openings in the valve members are preferably shaped such that when the valve members are turned to a position of least overlap, such overlap is at the parts of the openings nearest the axis so that swirling air remains longer in the mixing chamber at low rates of air flow.

In one form of the invention the relative shapes of the first and second openings produce a non-linear relationship between the area of overlap and the relative positions of the inner and outer valve members such that at low rates of air flow the area increases relatively faster than the relative turning of the outer and inner valve members in the opening direction. Preferably, the non-linear relationship is made such as to approximate the non-linear response of a conventional butterfly valve. The respective openings are preferably equally spaced around the axis of the valve members, and the means for introducing fuel comprises a fuel conduit adjacent each of the second openings with means for supplying fuel at the same rate to each of the fuel conduits, each of the conduits having a plurality of outlet orifices successively opened to a respective second opening upon turning of the outer valve member in the direction increasing the overlap.

It is therefore a primary object of the present invention to provide a carburetor for an internal combustion engine having an intake chamber, which carburetor includes a pair of relatively rotatable valve members confining a coaxial internal mixing chamber having a cross section increasing in the direction of air flow, the valve member being relatively rotatable to vary the restriction to air flow, said valve members being shaped to provide a component of air flow into the mixing chamber in the direction of the open end and at the same time providing a component of air flow transverse of the open end of the mixing chamber and offset from its axis to produce controlled swirling of air within the mixing chamber.

Other objects and advantages of the present invention will be made evident from consideration of the following detailed description, particularly when taken in conjunction with the accompanying drawings in which:

FIG. 8 is a plan view of the carburetor illustrated in FIG. 7;

FIG. 9 is a sectional view taken along line 9—9 of FIG. 7 showing the relative positions of the inner and outer valve members of the carburetor unit as provide a transverse component air flow offset from the radial direction;

FIG. 10 is an isometric view of the carburetor shown in FIG. 7 with the fuel distributing conduits in place;

FIG. 11 is an enlarged vertical sectional view of the fuel conduits and fuel splitting mechanism shown in FIG. 7;

FIG. 12 is an isometric view of the structure of FIG. 11;

FIG. 18 is an isometric view of an alternative form of carburetor in accordance with the present invention;

FIG. 19 is a sectional view of the carburetor shown in FIG. 18 taken along line 19—19 in FIG. 20; and FIG. 20 is a plan view of the carburetor shown in FIG. 18.

As stated above, the present invention is particularly useful in internal combustion engines having air-fuel control systems wherein fuel is supplied in metered amounts providing a particular desired ratio of air to fuel for engine operation. In such systems, air flow to the intake manifold of the engine is controlled and measured, and air flow rate, usually in conjunction with other parameters, is used to develop a control signal used for providing fuel at the desired air/fuel ratio. Thus, the present invention may be utilized in fuel control systems such as that described in U.S. Pat. No. 3,817,225, issued June 18, 1974 to Jack C. Priegel.

Figure 1:
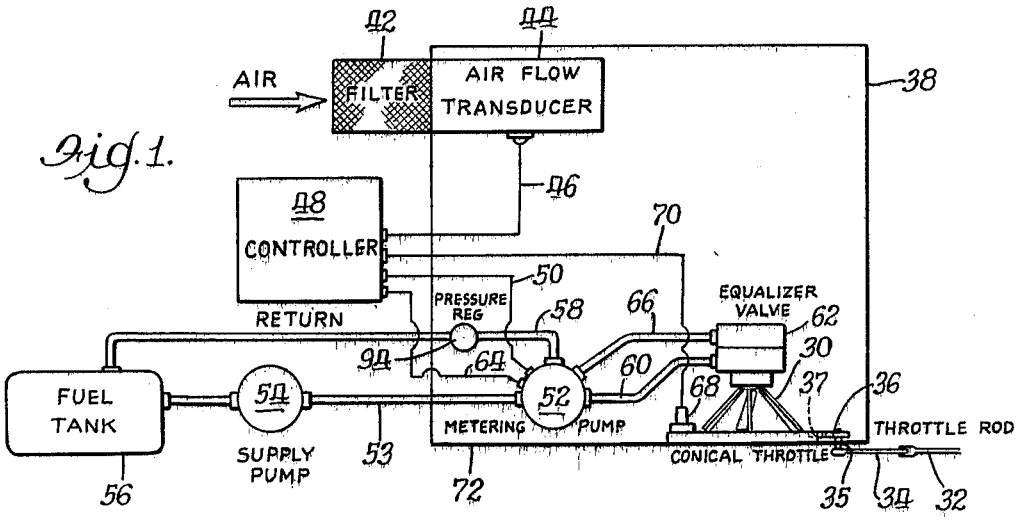
FIG. 1 is a diagrammatic illustration of a controlled air-fuel system for an internal combustion engine utilizing the carburetor of the present invention.

In FIG. 1 there is illustrated very generally an air and fuel control system like that shown by Priegel for supplying an appropriate mixture of air and fuel to the intake manifold of an internal combustion engine, which system has been modified, among other things, to utilize the carburetor of the present invention.

More particularly, the system of FIG. 1 includes a carburetor 30 which, as shown, is preferably conical. As a principal function of the carburetor 30 is to control the rate of flow of air to an intake manifold of an engine, the conical carburetor 30 is sometimes referred to as a conical throttle. The opening of the throttle is controlled by a throttle rod 32 which may be connected, for example, to a conventional automobile accelerator pedal. The throttle rod 32 may be connected through a crank 34, a shaft 35 and gears 36 and 37 to control the throttle opening and hence the rate of flow of air into the intake manifold. The conical throttle is enclosed in a housing 38 which fits over the intake manifold 40 of an internal combustion engine as better seen in FIGS. 2 and 4, with the interior of the housing 38 being open to the intake manifold 40 through the carburetor 30. The throttle control linkage passes through the housing 38 at the shaft 35.

All air flowing into the intake manifold flows through the housing 38, flowing into the housing through a filter 42 and an air flow transducer 44. The air flow transducer 44 measures the rate of air flow into, and hence out of, the housing 38 by producing a systematically related electrical signal on a conductor 46 which goes to an appropriate controller 48. The controller 48 may receive other signals from other sensors, such as temperature and pressure sensors, and may operate generally like the controller described in Priegel U.S. Pat. No. 3,817,225, utilizing the various signals to provide an appropriate fuel control signal on a conductor 50 to a metering pump 52.

The metering pump 52 is supplied with fuel through a conduit 53 by a supply pump 54 from a fuel tank 56 with any excess fuel being returned to the fuel tank 56 through a return conduit 58. The metering pump 52 supplies fuel to the carburetor 30 through a conduit 60 and an equalizer valve 62. A feedback signal indicative of pump speed is applied over a conductor 64 to the controller 48, which utilizes the feedback signal to assure that the metering pump operate at the desired speed. Reference pressure is applied to the equalizer valve 62 through a conduit 66.

Also illustrated generally in FIG. 1 is a bypass throttle 68 which operates as an auxiliary air control for admitting a controlled additional amount of air into the intake manifold 40, as may be called for by a signal developed in the controller 48 and applied to the bypass throttle over a conductor 70.

It should be noted that each of the conductors 46, 50, 64 and 70, shown as a single line in FIG. 1, may comprise a pair of conductors to provide a return path for completion of the respective signal circuit.

Figure 2:
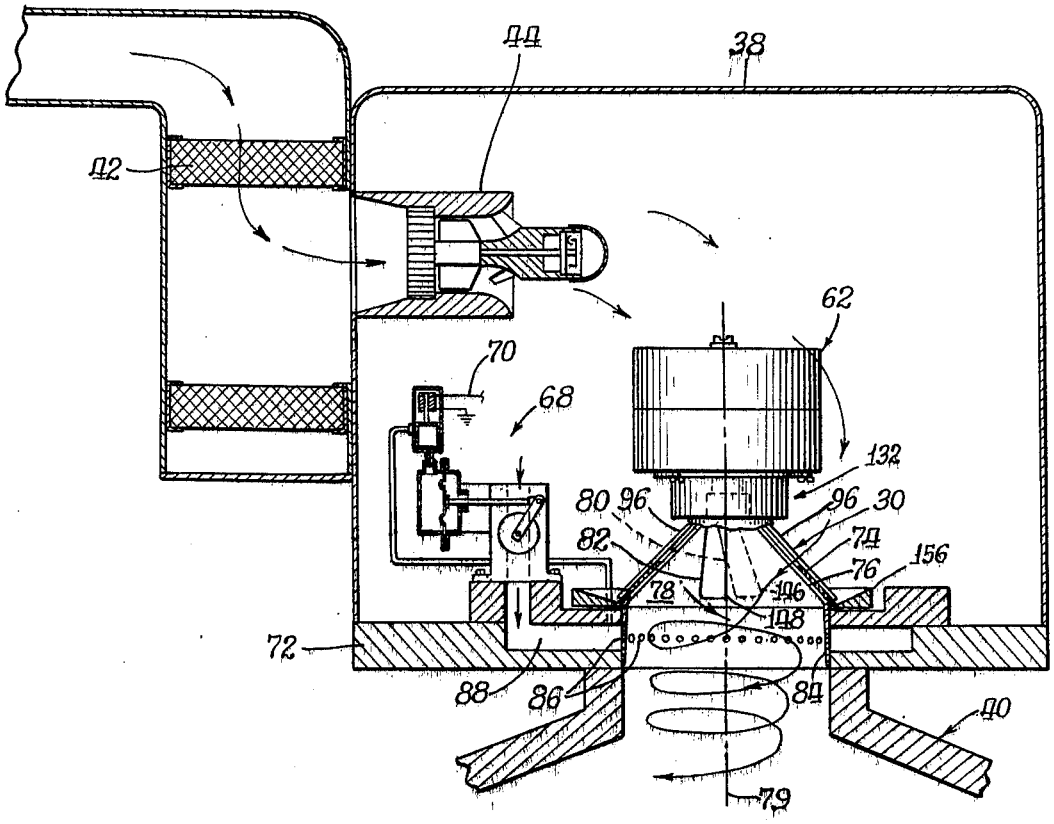
FIG. 2 is a vertical sectional view of the air flow system shown generally in FIG. 1.

As shown more particularly in FIG. 2, the housing 38 includes a base 72 which is mounted on the intake manifold 40 and on which the carburetor 30 is mounted, with the outlet of the carburetor 30 directly over the inlet to the intake manifold 40. The carburetor 30 is formed of a pair of valve members 74 and 76. The valve members 74 and 76 are preferably in the form of conical shells, as illustrated, and hence may be referred to as the outer cone 74 and inner cone 76, respectively. Both cones are hollow, the inner surface of the inner cone 76 forming a mixing chamber 78 wherein fuel and air are mixed.

The inner cone 76 is rigidly fastened to the base 72; whereas the outer cone 74 is rotatably mounted above the inner cone 76 with the inner cone nesting in the outer cone. That is, the outer surface of the inner cone 76 and the inner surface of the outer cone 74 are formed as surfaces of revolution about an axis 79 which, in the case of the carburetor illustrated, is a vertical axis down the centers of the cones. The outer cone 74 may thus be rotated about this axis relative to the inner cone 76 by operation of the throttle rod 32. To facilitate relative rotation, the outer cone may be mounted on bearing surfaces, keeping the mating surfaces slightly spaced from one another, reducing likelihood of binding. The inner cone is made fixed because it is fully exposed to the manifold vacuum, and the outer cone is relatively gently held against the inner cone by the relative pressures on the two sides of the outer cone. Were the outer cone fixed, the inner cone would be pulled away therefrom by the manifold vacuum, requiring additional means, such as a spring, to hold them together to limit air leakage between the cones.

Figure 3:
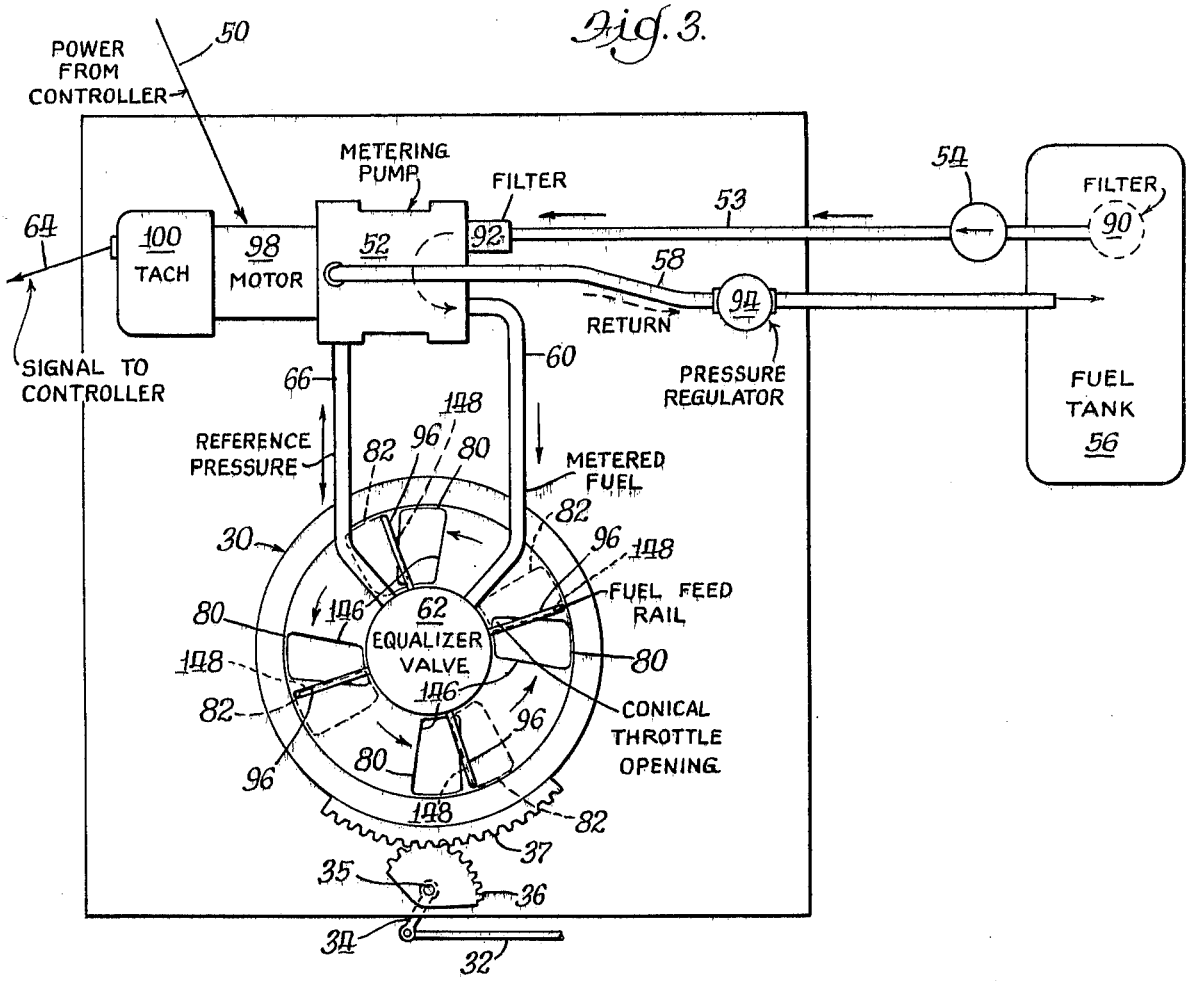
FIG. 3 is a plan view of the fuel system shown generally in FIG. 1.

As better shown in FIG. 3, the outer cone 74 includes a plurality of first openings 80 which are substantially identical to one another and are equally spaced around the axis of the cone 74. The inner cone 76 has a plurality of second openings 82 corresponding to the first openings in the outer cone whereby, when the cones are rotated relative to one another, the amount of overlap of the respective openings changes.

The inner cone 76 terminates in a skirt section 84 perforated by holes 86 that furnish passages for air between a channel 88 in the base 72 and the interior of the inner cone 76. The holes 86 and the channel 88 provide passages for air flowing through the bypass throttle 68.

FIG. 3 illustrates the fuel feed system of FIG. 1 with greater particularity. The disclosed fuel feed system supplies fuel at a metered rate from the reservoir or fuel tank 56 to the overlapping first and second openings 80 and 82 of the carburetor 30. Fuel is pumped from the fuel tank 56 by the supply pump 54 through a filter 90 in the fuel tank 56 and thence through the conduit 53 to the inlet to the metering pump 52, where it passes through a second filter 92. The second filter 92 may take the form of a flow-through filter formed as a tube connecting the conduit 53 to the return conduit 58 so as to make the second filter self cleaning, the filtered fuel going to the metering pump through the wall of the tube. The fuel pumped by the supply pump 54 to the metering pump 52 that is in excess of the demand of pump 52 passes on to the return conduit 58, whence the excess fuel returns to the fuel tank 56 through a pressure regulator valve 94. The pressure regulator valve 94 regulates the fuel pressure at the inlet side of the metering pump 52, maintaining such pressure sufficiently high as substantially to preclude the formation of bubbles in the fuel. Pressures in excess of 30 psi have proven satisfactory, for example, about 40 psi. Bubbles are undesirable, as they displace liquid and hence would make the metering pump non-linear. The inlet pressure is applied through the conduit 66 to one side of the equalizer valve 62. The metering pump 52, which may be a gear pump, supplies fuel at a metered rate, as will be described below, through the conduit 60 to the other side of the equalizer valve 62 and thence through rails 96 and the overlap of the openings 80 and 82 into the mixing chamber 78 in the interior of the conical throttle 30.

The rate at which the metering pump 52 operates is determined by the speed of a metering pump motor 98 which drives the metering pump 52 itself. The speed of the motor 98 is controlled by the power supplied to the motor 98 from the controller 48 over the conductor 50. The speed at which the motor 98 and, hence, the metering pump 52 operate is measured by a tachometer 100 which produces a signal on the conductor 64 which indicates pump speed.

The metering pump 52, particularly when used with the equalizer valve 62 described more fully below in connection with FIG. 7, operates to pump liquid at a rate proportional to the speed of the pump; hence the signal indicative of motor and pump speed is a measure of rate of fuel flow. This signal is applied as a feedback signal to the controller 48. The controller 48 may operate as the controller disclosed in the aforesaid Priegel U.S. Pat. No. 3,817,225 to compare a signal dependent upon air flow with the feedback signal to produce a driving signal to the motor 98 over the conductor 50 to supply fuel to the rails 96 at the appropriate air/fuel ratio for which the controller is programmed.

Figure 4:
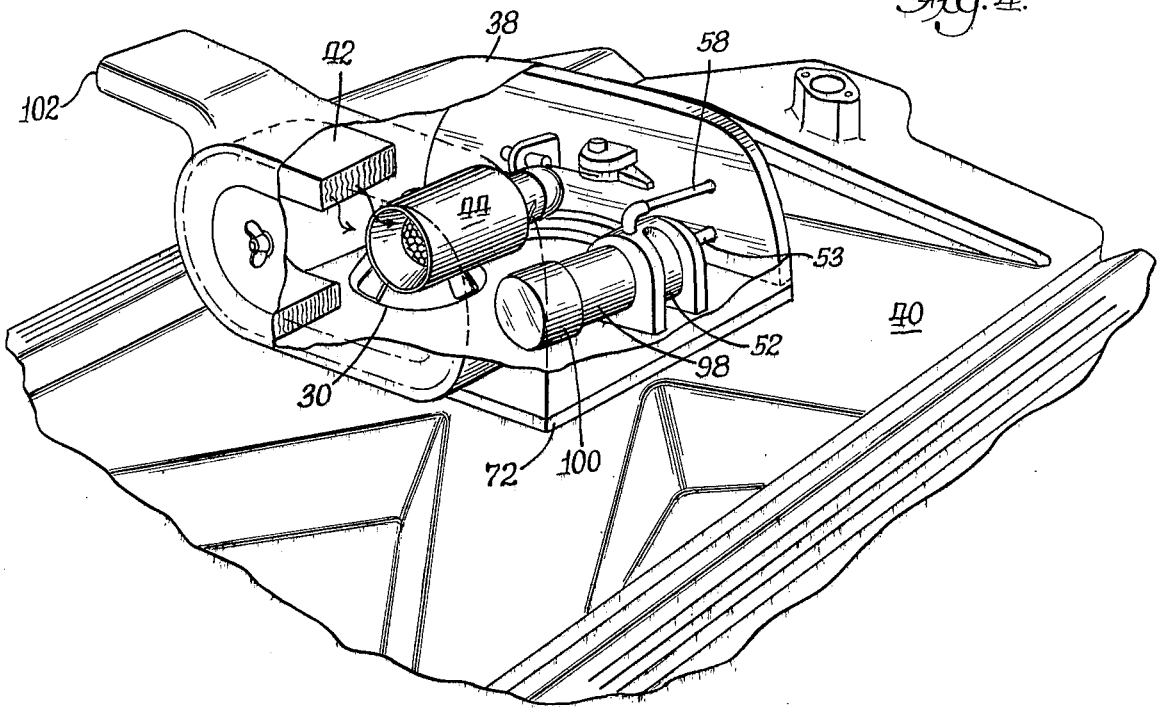
FIG. 4 is an isometric view of the mechanical parts of a specific system of the sort shown generally in FIGS. 1 to 3, with the components mounted on the intake manifold of a piston driven gasoline engine and with portions partly broken away.

FIG. 4 illustrates one form of air/fuel control system utilizing the carburetor 30 of the present invention as mounted in place over the intake manifold 40 of an internal combustion engine. FIG. 4 illustrates one manner in which the various system components may be assembled within the housing 38 on the baseplate 72. The housing 38 has been broken away to show the arrangement of the system components. Air is taken into the system through an air intake 102 and thence through the filter 42. The filtered air passes through the air flow transducer 44 into the interior of the housing 38, which houses the carburetor 30 and the metering pump 52. The metering pump 52 is driven by the pump motor 98 and its speed is measured by the tachometer 100. Fuel from the supply pump 54 is supplied through the conduit 53 to the fuel pump 52 with the return flow through the conduit 58.

Figure 5:
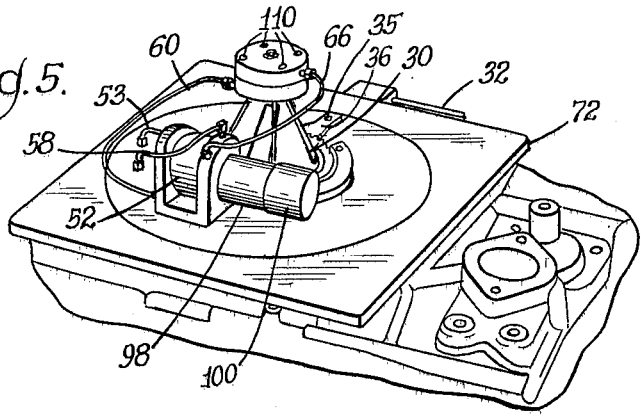
FIG. 5 is a simplified isometric view of a modified form of a portion of the system shown generally in FIGS. 1 to 3 similarly mounted on an intake manifold.
Figure 6:
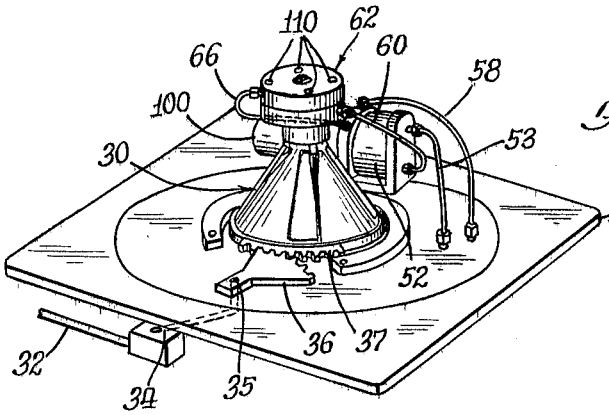
FIG. 6 is a similar isometric view of the apparatus shown in FIG. 5, taken from the other side of the unit.

FIGS. 5 and 6 are simplified views of a modified form of the system of the present invention showing the carburetor 30 and the metering pump 52 mounted on the baseplate 72 and the connections therebetween. Other parts of the system that are normally within the housing 38 have been deleted to facilitate an understanding of these connections. In this form of the invention the conduits 53 and 58 to and from the fuel tank 56 extend through the baseplate 72. FIG. 6 shows the same apparatus as FIG. 5 but from the opposite side.

Figure 7:
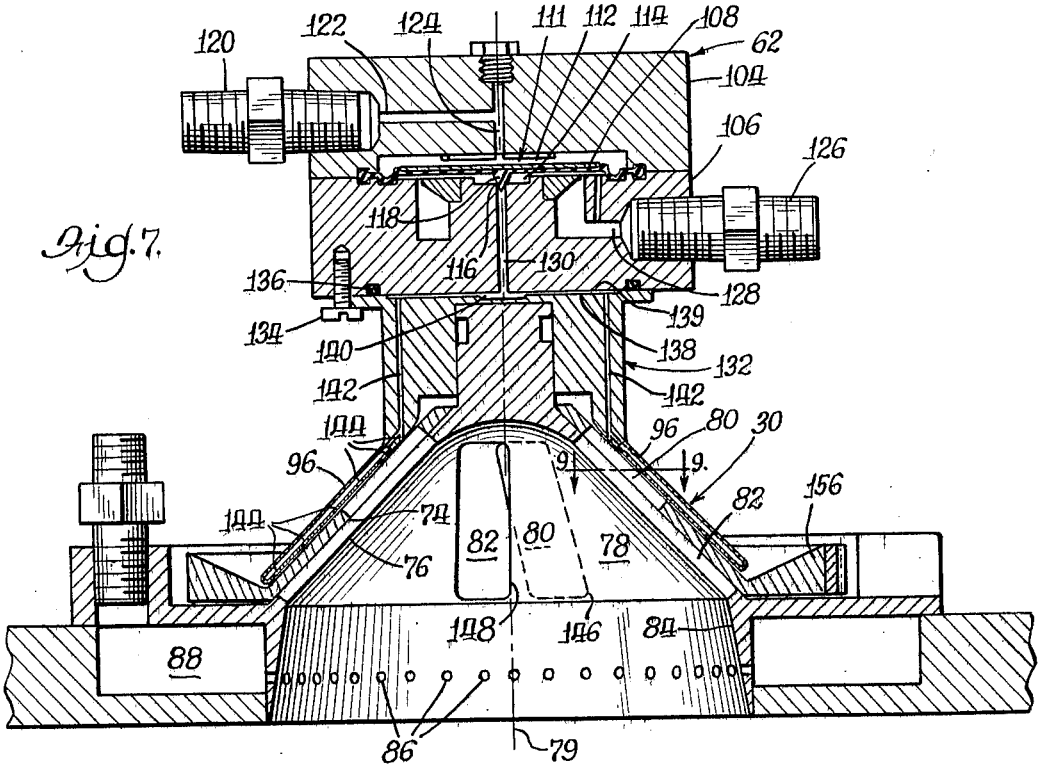
FIG. 7 is an enlarged axial vertical sectional view, taken along line 7—7 in FIG. 8, of the carburetor shown in FIG. 2 as mounted in place on a mounting plate and with an equalizer valve.

FIG. 7 is an enlarged vertical sectional view of the carburetor 30 of the present invention with the equalizer valve 62, also shown in section, in its operating position mounted on the carburetor 30. As shown, the equalizer valve 62 preferably comprises an upper member 104 and a lower member 106 with a flexible diaphragm 108 clamped therebetween, as by the use of screws 110 (see FIGS. 5 and 6). The upper and lower members are shaped to form a valve chamber 111 divided into two parts by the diaphragm 108, an upper part 112 and a lower part 114. The lower part 114 has an outlet orifice 116. The diaphragm 108 carries a pointed valve closure member 118 which cooperates with the outlet orifice 116 to form a needle valve. The pump reference pressure is applied through the conduit 66 to a fitting 120 which couples the reference pressure through conduits 122 and 124 to the upper part 112 of the valve chamber. Metered fuel is supplied through the conduit 60 to a fitting 126. Thence, it passes through a passage 128 to the lower part 114 of the valve chamber 111.

With the metering pump 52 stopped, the pressures in the two parts 112 and 114 of the valve chamber 111 are equalized, and the diaphragm 108 is biased to cause the valve closure member 118 to close the outlet orifice 116. When the metering pump motor 98 is energized, it turns the metering pump 52 at the speed to supply fuel at the desired rate to the lower part 114 of the valve chamber 111, increasing the pressure therein, and hence forcing the diaphragm 108 upward and unseating the valve closure member 118, whereupon the metered amount of fuel passes through the orifice 116 and thence through a conduit 130 through the lower member 106 to a flow splitter 132. As the pressure needed to unseat the valve closure member 118 is relatively low, the pressure differential across the metering pump is small, limiting pump leakage during pumping, and as the valve closure member is seated at pump standstill, precluding leakage at standstill, proportionality of fuel rate with pump speed is maintained, while at the same time permitting operation at the relatively high pressure desired for precluding the formation of bubbles.

The flow splitter 132 is clamped to the lower member 106 by screws 134 and is sealed thereto by an O-ring 136. The flow splitter has a flat upper surface 138 displaced from the lower surface 139 of the lower member 106, which is also flat, by a relatively thin space which may be about 0.0015 inches. A cut out central section of the flow splitter 132 provides a receptacle 140 at the end of the conduit 130 to receive the fuel passing through the conduit 130. The receptacle 140 also distributes the fuel around the receptacle 140 to the thin space between the wall 139 of the lower member 106 and the upper surface 138 of the flow splitter 132. The thin space provides a constriction in the fuel flow path which causes the fuel to spread out in all directions, the space being so narrow as to assure substantially equal flow in all directions. A plurality of fuel passages 142 extend through the upper surface 138 to provide exit passages for fuel passing through the space between the flow splitter 132 and the lower member 106. The flow passages 142 are equally distributed about the central axis of the unit so that equal amounts of fuel flow through the respective fuel passages 142.

The fuel passages 142 extend down to the fuel rails 96, the fuel rails 96 having a plurality of outlet orifices 144. The fuel flows out of the orifices 144 through the overlaps of the openings 80 and 82 into the mixing chamber 78 of the carburetor 30. A more detailed description of the flow of the fuel from the fuel rails into the mixing chamber will be given below.

FIG. 8 is a plan view of the carburetor 30 shown in FIG. 7 with the equalizer valve 62 and the flow splitter 132 removed. This view shows in greater detail a particular arrangement of openings 80 and 82. In general, each of the openings has a radial edge, that is, an edge extending along the respective cone in a plane including the axis of the cone. Thus, each first opening 80 in the outer cone 74 includes a radial edge 146 and each second opening 82 in the inner cone has a radial edge 148. The openings may be generally in the shape of parallelograms, as illustrated.

Important aspects of the present invention are the shapes and directions of the orifices formed by the valve members 74 and 76 at the overlapping of the respective first openings 80 and second openings 82. Such orifices at the overlaps are effectively constrictions in the air flow. Were the valve members 74 and 76 made so thin as to have no substantial thickness, the constrictions at the openings 80 and 82 would be substantially perpendicular to axial planes. Flow through each constriction would hence be directed toward the axis where, in the symmetrical configuration illustrated, it would meet air coming through an opposing constriction, creating turbulence and directing the flow downward and out of the mixing chamber. In accordance with the present invention, it has been found desirable to cause the air to swirl within the mixing chamber 78 before passing therefrom, so as to remain longer in the chamber and facilitate evaporation of the fuel and mixture of fuel droplets with the air.

To achieve this swirling the valve members 74 and 76 are made of substantial thickness. Thus, when the respective surfaces of revolution of the valve members 74 and 76 nest one within the other, the other surfaces of the members 74 and 76 are displaced from the nesting surfaces in opposite directions presenting the configuration illustrated in FIG. 9, which is a partial sectional view taken perpendicular to the axis 79. The thickness of the members 74 and 76 make the constriction at the overlapped openings other than perpendicular to the plane of the axis 79 indicated by line 150. The flow through the constriction, being generally perpendicular thereto, is then at an angle to the plane of the axis, as indicated by the arrow 152. As the section shown in FIG. 9 is orthogonal to the axis 79, the transverse component of air flow at each constriction is orthogonal to the direction parallel to the axis and is offset from the plane of the axis in the same sense at each constriction (e.g., clockwise as shown in FIG. 9), thus causing a swirling of air within the mixing chamber.

The amount of swirling is dependent upon the thicknesses of the respective members 74 and 76 and upon the shapes of the edges of the openings 80 and 82. These thicknesses and shapes may be determined empirically to provide the desired degree of swirling for a particular engine and a particular carburetor 30. The direction of the flow should not provide so much swirling as to cause the resulting centrifugal forces on the fuel droplets to deposit the fuel upon the inner wall of the inner valve member 76, as this will cause the excessive accumulation of fuel. Such accumulation could result in intermittent drops of fuel falling into the intake manifold 40, thus providing an excessively enriched fuel mixture from time to time beyond what is called for by the controller 48, meanwhile providing a mixture too lean at other times as the fuel accumulates on the inner surface of the inner valve member 76. Of course, some of the swirling air-fuel mixture comes in contact with the inner wall of the inner valve member 76. To facilitate the prompt removal of any accumulating fuel, and hence minimize rich and lean intervals, the second openings 82 extend substantially the length of the mixing chamber 78 and are formed by relatively sharp edges on the inner wall. The swirling air-fuel mixture then acts to scour the inner wall and move fuel to the next opening, where it is stripped from the edge of the opening by the entering air.

The degree of swirling is coordinated with the flow rate and the flow direction as determined by the shapes of the valve members 74 and 76. In the preferred form of the invention where the valve members are conical, it has been found suitable to provide an apex angle, that is, the angle in the plane of the axis 79 between the axis and the conical surfaces of revolution, of about 45°. This provides a substantial axial component of flow while at the same time providing a transverse component as produces the desired swirling. If the apex angle is too great, the axial component is so large that the air-fuel mixture passes from the mixing chamber with relatively little mixing. On the other hand, if the apex angle is made too small, the air-fuel mixture remains too long in the mixing chamber and encourages excessive deposit of fuel on the inner surface of the inner valve member 76. At an apex angle of at least 45°, air as it flows through the constriction is flowing generally in such direction as to miss the opposite side of the cone if not deflected by another inflowing air stream. Angles greater than 45° therefore further inhibit fuel accumulation. Other criteria may dictate a smaller angle. For example, some engines require a relatively high rate of air flow into a relatively small manifold opening. A smaller apex angle may then be used to provide an air flow area through the overlaps that is large relative to the opening to the manifold.

FIG. 10 is an isometric view of the structure shown in FIG. 7 with the equalizer valve removed, thus showing the flow splitter 132 with the rails 96 in place over the respective openings 80 and 82. The flow splitter 132 is illustrated in greater detail in FIGS. 11 and 12. The fuel splitter 132 is held in place with respect to the inner valve member 76 by a set screw 154. As shown particularly in FIGS. 3, 9 and 10, the rails 96 are above and parallel to the radial edges 148 of the inner valve member 76. The outer valve member 74 comes between the rails 96 and the second openings 82 except where the first openings 80 overlap the second openings 82.

The metered fuel passing through the outlet conduit 130 of the equalizer valve 62 is divided by the flow splitter 132 so as to flow in equal amounts through the respective rails 96. The rail orifices 144 provide outlets through which the fuel may enter the mixing chamber 78. However, it may be noted that when fuel reaches the orifices 144 near the top of the mixing chamber 78, the air flow past these orifices and through the respective overlaps in the openings 80 and 82 aspirates the fuel from the exposed orifices. This is further enhanced by the relatively low pressure within the mixing chamber 78 occasioned by the manifold vacuum created by the pumping action of the pistons of the engine. At the same time, those orifices 144 obstructed by the upper valve member 74 are open to ambient pressure conditions within the housing 38, which are necessarily higher than the manifold vacuum. Hence, air will flow into the lower rail orifices and back up the inside of the rails to where the air meets the fuel coming the other way and passing out of the unobstructed orifices open to the mixing chamber 78.

In the event there should be any flow of fuel to the outside of the outer valve member 74 which is not entrained with air flow through the respective openings into the mixing chamber 78, such fuel is caught by a raised rim 156 on the bottom of the outer valve member 74. The fuel caught by this rim 156 then flows through the bottoms of the openings 80 and 82 into the interior of the carburetor 30.

In general, the first openings are made essentially identical to the corresponding second openings, and the respective openings are arranged so that at the limit of throttle closure the openings overlap only at the very top. This provides entry of air and fuel at engine idle at the apex of the throttle, assuring a relatively longer dwell of the air-fuel mixture in the mixing chamber, thus providing better fuel vaporization and air-fuel mixing at idle and low engine speeds, conditions when proper air-fuel mixing are most critical. It may be noted here that additional air at engine idle, and any other conditions as determined by the controller 48, is supplied through the bypass throttle 68 by way of the channel 88 and holes 86 in the skirt 84 of the lower valve member 76.

The shapes of the respective openings 80 and 82 determine the response characteristic of the carburetor 30 and hence the response characteristic of the engine as a function of the position of the accelerator control mechanism. That is, the response of an engine to the operator's positioning of the throttle rod 32 is determined by the shapes of the respective openings 80 and 82. Any number of desirable characteristics can be produced by appropriate shaping of the openings. However, one particular characteristic deserves comment. In the matter of safety of automobile operation, it is important that the operator understand the operating characteristics of the machine. As most automobile operators are accustomed to the response utilizing conventional carburetors with conventional butterfly valves, it is desirable to provide a response characteristic corresponding to that to which the operator is accustomed. To this end, the respective openings are shaped so that air flow as a function of throttle position increases less rapidly at the outset under these circumstances. Relatively large movements of the throttle produce relatively small changes in air flow and hence provide relatively accurate control at smaller air flows, facilitating starting, stopping and parking and careful control at low speeds. Typically, at high speeds accurate control is secondary.

The openings shaped as illustrated, for example, in FIG. 8, provide a substantially triangular initial overlap. Under these circumstances the area of overlap and hence the rate of air flow increases substantially as the square of throttle displacement until the triangular section covers the entire length of respective openings. After this point the increase in area is a substantially linear function of throttle position.

Figure 13:
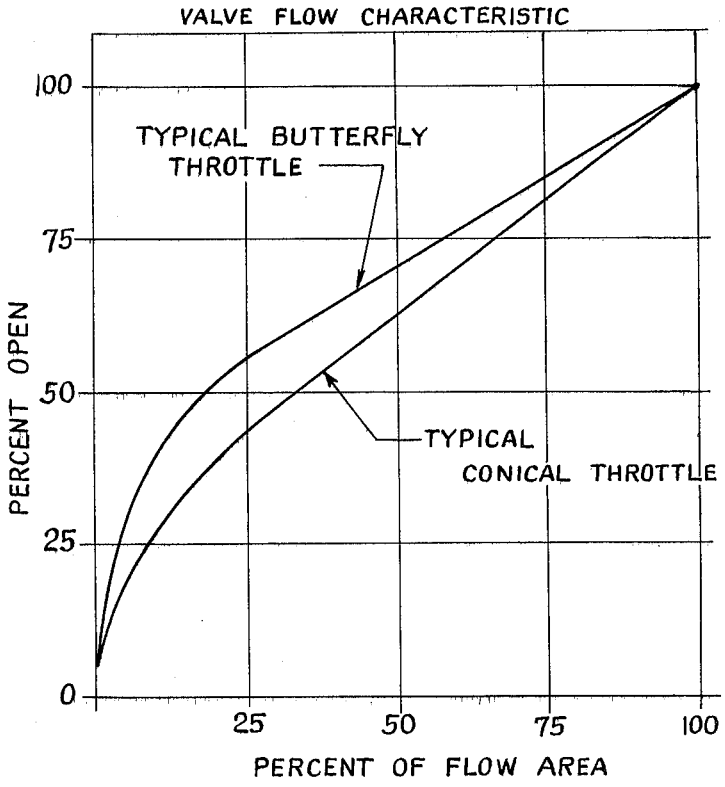
FIG. 13 is a graph showing the valve flow characteristic of a typical carburetor made in accordance with the present invention in comparison with the valve flow characteristic of a typical butterfly valve.

A comparison of the response characteristic of a typical conical throttle with the response characteristic of a typical butterfly throttle is provided by FIG. 13 wherein the respective curves show percent of throttle opening as a function of the percent of flow area for a conical throttle and a butterfly throttle, respectively. As is evident from FIG. 13, the response characteristic of a typical conical throttle with openings formulated as described above may closely approximate the response characteristic of a typical butterfly throttle.

Figure 14:
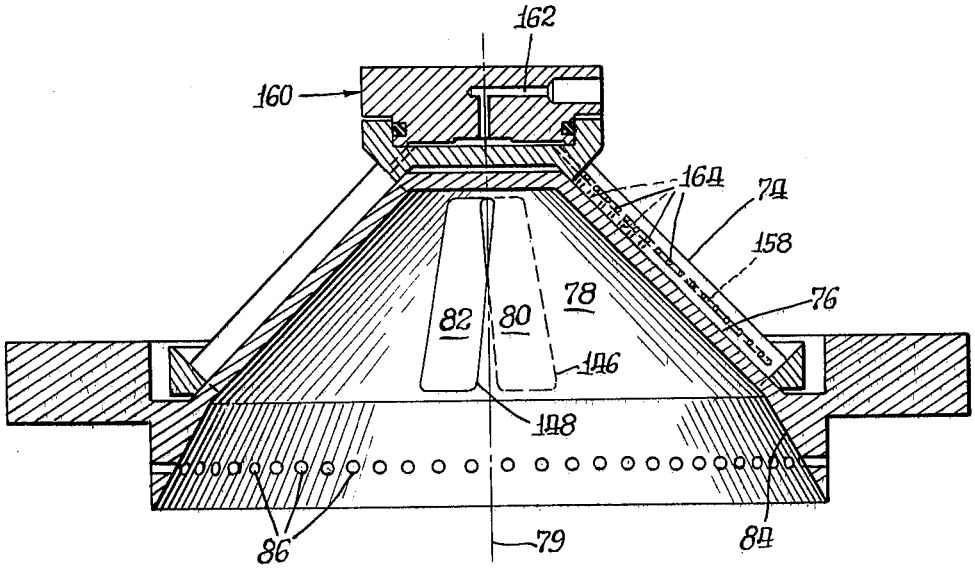
FIG. 14 is a sectional view of another form of carburetor in accordance with the present invention taken along line 14—14 in FIG. 15.
Figure 15:
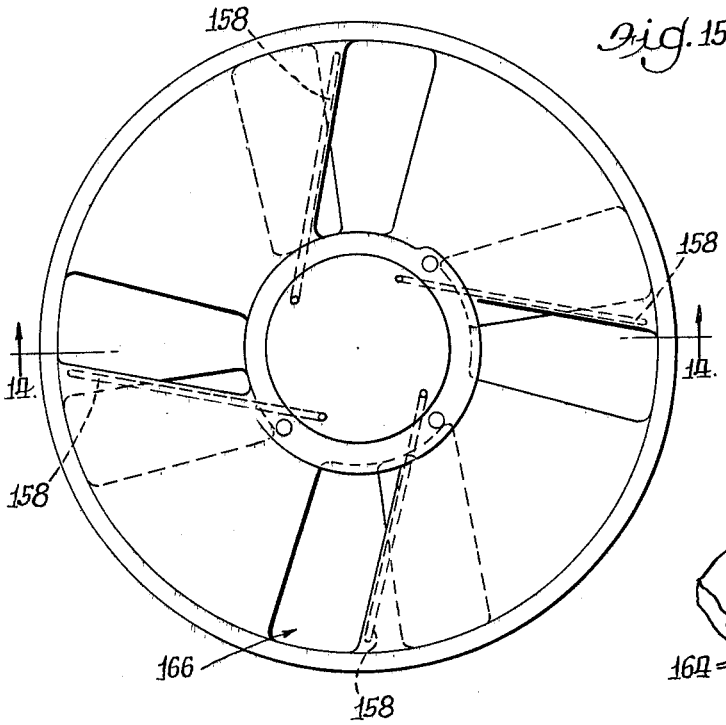
FIG. 15 is a plan view of the carburetor shown in FIG. 14 with the flow splitting device removed.
Figure 16:
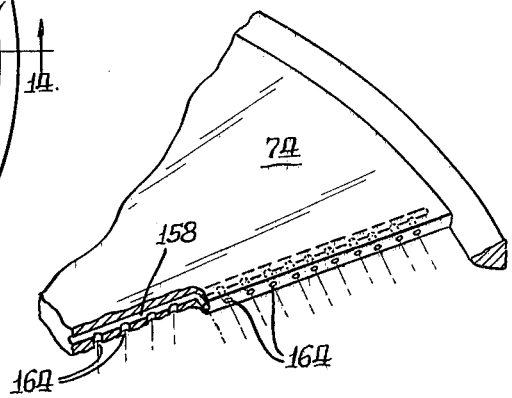
FIG. 16 is a fragmentary isometric view of the carburetor of FIG. 14 showing an internal fuel conduit.

FIGS. 14 to 16 illustrate an alternative form of the carburetor of the present invention wherein the fuel rails are not formed separately, but rather are in the form of conduits 158 in the upper valve member 74. In this case a flow splitter 160 may take the form illustrated in FIG. 14, which is essentially the inverse of the flow splitter 132 illustrated in FIGS. 7 to 11. In this case the output of the equalizer valve 62 is supplied through a passageway 162 in the flow splitter 160. The flow splitter 160 divides the flow equally among the four conduits 158. In this form of the invention the flow splitter turns with the outer valve member 74, and orifices 164 from the conduits 158 are blocked by the inner valve member 76 where the respective openings do not overlap. As illustrated, the orifices 164 nearest the axis are preferably directed inwardly for inward flow of fuel at low flow rates, whereas the outer orifices 164 are directed across the air flow for flow out into the air stream at high flow rates.

Figure 17:
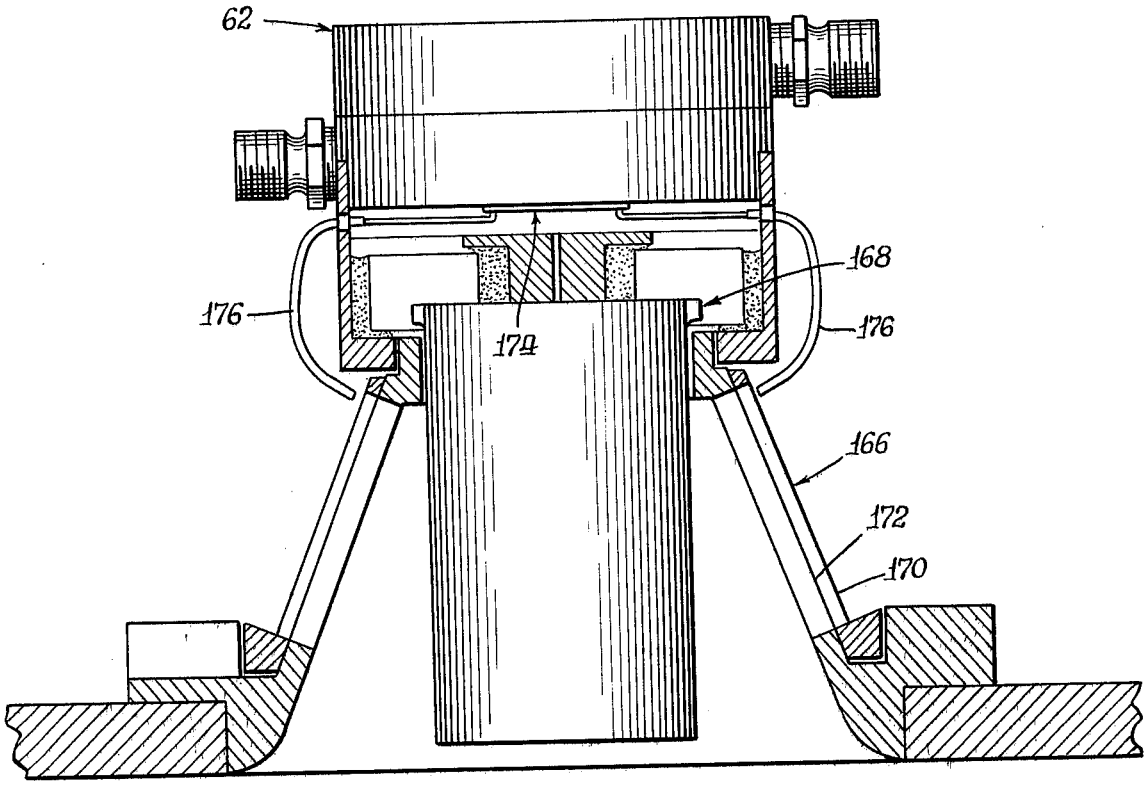
FIG. 17 is a side view partly in section showing an alternative carburetor arrangement with alternative fuel supply and fuel atomizing means.

FIG. 17 illustrates a carburetor 166 of somewhat different form to accommodate a different arrangement of fuel feed and fuel atomization. More particularly, the carburetor 166 is designed to accommodate an ultrasonic atomizer 168 of the sort illustrated in Martner U.S. Pat. No. 3,986,669. Such ultrasonic atomizer takes up a substantial amount of the space within the carburetor 166, which is formed by an outer valve member 170 and inner valve member 172. A flow splitter 174 provides equalized flow of fuel through conduits 176 and thence through respective openings in the valve members 170 and 172 against the ultrasonic atomizer 168, where the fuel is atomized for mixture with air flowing through the openings.

FIGS. 18 to 20 illustrate a carburetor 178 in a form that would accommodate an ultrasonic atomizer like that shown in FIG. 18 or other types of atomizers or fuel feeds wherein fuel is supplied centrally of the carburetor, rather than through openings in the air valve members. The carburetor of FIGS. 18 to 20 has respective outer and inner valve members 180 and 182, each formed of two conical figures of revolution. The outer valve member 180 has an upper conical portion 184 and a lower conical portion 186, while the inner valve member 182 has an upper conical portion 188 and a lower conical portion 190. The upper conical portions 184 and 188 have respective openings 192 and 194 corresponding generally to the openings 80 and 82 of the carburetor shown in FIGS. 7 to 10. The lower conical portions 186 and 190 have respective openings 196 and 198, where the former are much narrower than the latter. This provides a flow characteristic wherein once the lower openings 196, 198 fully overlap, the overlapping section remains constant as the overlap of the upper openings 192, 194 increases.

While certain preferred embodiments of the invention have been illustrated and described for particular engines, particular air-fuel control systems, and particular conditions, it should be understood that many modifications can be made to the apparatus within the scope of the present invention. For example, other shapes of valve members and valve openings may be more desirable under certain operating conditions or for different fuel control systems or different engines. Different structure at the openings can be used to provide different directivity to the air flow and different air velocity, high velocity being desirable for some applications.

In a modification of the carburetor shown in FIGS. 14 to 16, the conduits 158 can be formed by separate tubing, like the rails 96 but mounted on and carried by the upper valve member 74, spaced from the edges of the openings 80 to permit air flow between the conduits 158 and the respective edges of the respective openings.

In a modification of the rails 96, the rail orifices 144 are in the form of slots. In a further modification, there is a single slot for each rail.

What is claimed is:

1. A carburetor for an internal combustion engine having an intake chamber, said carburetor comprising a hollow outer air control valve member having an interior surface of revolution about an axis, said outer valve member having a plurality of first openings spaced around said axis and extending through said outer valve member to said interior surface, a hollow inner air control valve member nesting in said outer valve member and having an exterior surface of revolution mating with said interior surface of revolution and coaxial therewith, said inner valve member confining a coaxial internal mixing chamber having a cross section increasing in the direction away from said mating surfaces and terminating in an open end, said inner valve member having a plurality of second openings corresponding to said first openings and extending between said exterior surface and said mixing chamber, means for mounting said outer and inner valve members to intercept air inflow into said intake chamber with said open end open into said intake chamber and with said outer and inner valve members being turnable relative to each other about said axis, means for turning one of said inner and outer valve members relative to the other about said axis to change the overlap of said first and second openings and thereby vary the constriction of air flow at the overlaps to control the rate of air flow into said intake chamber, said mating surfaces sloping away from said axis in the direction of said open end for directing air flow through each overlap of said first and second openings with an axial component of air flow through such overlap into said mixing chamber parallel to said axis and a transverse component orthogonal to said axial component, said axial component being in the direction of said open end, means for directing air flow through each such overlap to offset said transverse component from the direction toward said axis, thereby causing a swirling of air within said mixing chamber, and means for introducing liquid fuel into air swirling within said mixing chamber.

2. A carburetor according to claim 1 wherein the direction transverse to the effective constriction at each overlap produces swirling air without such centrifugal forces as cause substantial wetting out on said inner valve member of fuel particles carried by the swirling air.

3. A carburetor according to claim 1 wherein said first openings are substantially identical to each other, said second openings are substantially identical to each other, and said first and second openings, respectively, are substantially equally spaced about said axis.

4. A carburetor according to claim 3 wherein the direction transverse to the effective constriction of each overlap produces swirling air without such centrifugal forces as cause substantial wetting out on said inner valve member of fuel particles carried by the swirling air.

5. A carburetor according to claim 1 wherein when said valve members are turned to a position of least overlap of said first and second openings, such overlap is at the parts of said openings nearest said axis so that the swirling air remains longer in said mixing chamber at low rates of air flow.

6. A carburetor according to claim 1 wherein the relative shapes of said first and second openings produces a non-linear relationship between area of overlap and the relative positions of said outer and inner valve members, said area initially increasing relatively faster than the relative turning of said outer and inner valve members in the opening direction.

7. A carburetor according to claim 1 wherein said means for turning includes means for connecting to an automobile accelerator pedal operable by the operator of an automobile, and wherein the relative shapes of said first and second openings produces a non-linear relationship between area of overlap and the position of said accelerator pedal comparable to the response of a conventional butterfly valve.

8. A carburetor according to claim 1 wherein said means for introducing liquid fuel comprises a fuel channel adjacent each of said first openings, and means for supplying fuel at the same rate to each of said fuel channels, said fuel channels having respective orifices progressively opened to a respective second opening upon turning of said one of said inner and outer valve members in the direction increasing overlap of said first and second openings.

9. A carburetor according to claim 1 wherein said outer valve member is turnable and said inner valve member is fixed relative to said engine.

10. A carburetor according to claim 9 wherein said means for introducing liquid fuel comprises a fuel conduit adjacent each of said first openings, and means for supplying fuel at the same rate to each of said fuel conduits.

11. A carburetor according to claim 10 wherein each of said fuel conduits has a plurality of outlet orifices successively opened to a respective second opening upon turning of said outer valve member in the direction increasing overlap of said first and second openings.

12. A carburetor according to claim 10 wherein said axis is normally substantially vertical and said outer valve member includes an upturned rim at its lower extremity for catching fuel passing from said fuel conduits without passing through the respective first openings.

13. A carburetor according to claim 10 wherein one of said fuel conduits is mounted in fixed position over each of said second openings with said outer valve member interposed.

14. A carburetor according to claim 9 wherein said means for introducing liquid fuel comprises a fuel conduit carried by said outer valve member adjacent each of said first openings, and means for supplying fuel at the same rate to each of said fuel conduits, each of said fuel conduits having a plurality of outlet orifices successively opened to a respective second opening upon turning of said outer valve member in the direction increasing overlap of said first and second openings.

15. A carburetor according to claim 14 wherein said fuel conduits are formed integrally with said outer valve member.

16. A carburetor according to claim 1 wherein said inner valve member comprises a thin shell with one side forming said exterior surface of revolution and the other side forming said mixing chamber and with said second openings extending therethrough.

17. A carburetor according to claim 16 wherein said outer valve member comprises a thin shell with one side forming said interior surface of revolution and with said first openings extending therethrough.

18. A carburetor according to claim 17 wherein said shells comprising said inner and outer valve members are conical.

19. A carburetor according to claim 18 wherein said first openings are substantially identical to each other, said second openings are substantially identical to each other, said first and second openings, respectively, are substantially equally spaced about said axis, and the direction transverse to the effective constriction of each overlap produces swirling air without such centrifugal forces as cause substantial wetting out of fuel particles carried by the swirling air onto said other side of said shell comprising said inner valve member.

20. A carburetor according to claim 17 wherein said outer valve member is turnable and said inner valve member is fixed relative to said engine.

21. A carburetor according to claim 20 wherein said means for introducing liquid fuel comprises a fuel conduit mounted in fixed position over each of said second openings with said outer valve member interposed, and means for supplying fuel at the same rate to each of said fuel conduits, each of said fuel conduits having a plurality of outlet orifices successively opened to a respective second opening upon turning of said outer valve member in the direction increasing overlap of said first and second openings.

22. A carburetor according to claim 17 wherein when said valve members are turned to a position of least overlap of said first and second openings, such overlap is at the part of said openings nearest said axis so that the swirling air remains longer in said mixing chamber at low rates of air flow.

23. A carburetor according to claim 17 wherein the relative shapes of said first and second openings produces a non-linear relationship between area of overlap and the relative position of said outer and inner valve members, said area increasing relatively faster than the relative turning of said outer and inner valve members in the opening direction.

24. A carburetor according to claim 16 wherein said second openings extend substantially the length of said mixing chamber, and said other side of said shell has relatively sharp edges at said second openings to facilitate stripping of any fuel that wets said other side of said shell.

25. A carburetor for an internal combustion engine having an intake chamber, said carburetor comprising a hollow outer air control valve member having an interior surface of revolution about an axis, said outer valve member having a plurality of first openings spaced around said axis and extending through said outer valve member to said interior surface, a hollow inner air control valve member nesting in said outer valve member and having an exterior surface of revolution mating with said interior surface of revolution and coaxial therewith, said inner valve member confining a coaxial internal mixing chamber having a cross section increasing in the direction away from said mating surfaces and terminating in an open end, said inner valve member having a plurality of second openings corresponding to said first openings and extending between said exterior surface and said mixing chamber, means for mounting said outer and inner valve members to intercept air inflow into said intake chamber with said open end open into said intake chamber and with said outer and inner valve members being turnable relative to each other about said axis, means for turning one of said inner and outer valve members relative to the other about said axis to change the overlap of said first and second openings and thereby vary the constriction of air flow at the overlaps to control the rate of air flow into said intake chamber, said mating surfaces sloping away from said axis in the direction of said open end for directing air flow through each overlap of said first and second openings with an axial component of air flow through such overlap into said mixing chamber parallel to said axis and a transverse component orthogonal to said axial component, said axial component being in the direction of said open end, said first openings being disposed relative to said second openings at said overlaps for directing air flow through each such overlap to offset said transverse component from the direction toward said axis, thereby causing a swirling of air within said mixing chamber, and means for introducing liquid fuel into air swirling within said mixing chamber.

26. A carburetor according to claim 25 wherein said inner valve member comprises a thin shell with one side forming said exterior surface of revolution and the other side forming said mixing chamber and with said second openings extending therethrough.

27. A carburetor according to claim 26 wherein said outer valve member comprises a thin shell with one side forming said interior surface of revolution and with said first openings extending therethrough.

28. A carburetor according to claim 27 wherein said shells comprising said inner and outer valve members are conical.

29. A carburetor according to claim 28 wherein said first openings are substantially identical to each other, said second openings are substantially identical to each other, said first and second openings, respectively, are substantially equally spaced about said axis, and the direction transverse to the effective constriction of each overlap produces swirling air without such centrifugal forces as cause substantial wetting out of fuel particles carried by the swirling air onto said other side of said shell comprising said inner valve member.

* * * * *